United States Patent [19]

Meffert et al.

[11] Patent Number: 4,830,784

[45] **Date of Patent: * May 16, 1989**

[54] LAUNDRY DETERGENTS AND CLEANERS WITH REDUCED REQUIREMENT FOR CONVENTIONAL CHEMICALS

[75] Inventors: Alfred Meffert, Monheim; Brigitte Glesen, Duesseldorf-Grafenberg; Andreas Syldatk, Duesseldorf; Ingo Wegener, Duesseldorf; Johann F. Fues, Duesseldorf, all of Fed. Rep. of Germany

[73] Assignee: Henkel Kommanditgesellschaft auf Aktien, Duesseldorf, Fed. Rep. of Germany

[ * ] Notice: The portion of the term of this patent subsequent to Aug. 2, 2005 has been disclaimed.

[21] Appl. No.: 21,057

[22] Filed: Mar. 2, 1987

[30] Foreign Application Priority Data

Mar. 1, 1986 [DE] Fed. Rep. of Germany ..... 3606729

[51] Int. Cl.[4] ..... C11D 1/62

[52] U.S. Cl. ..... 252/547; 252/90; 252/91; 252/174; 252/174.25

[58] Field of Search ..... 252/90, 91, 174, 547, 252/174.25, 8.7, 8.8, 174.13

[56] References Cited

U.S. PATENT DOCUMENTS

| | | | |
|---|---|---|---|
| 3,580,853 | 5/1971 | Parran | 252/152 |
| 3,753,777 | 8/1973 | Thomsen et al. | 134/6 |
| 3,816,321 | 6/1974 | Kleinschmidt | 252/117 |
| 3,886,075 | 5/1975 | Bernardino | 252/547 |
| 4,014,808 | 3/1977 | Herpers et al. | 252/135 |
| 4,101,456 | 7/1978 | Renaud et al. | 252/551 |
| 4,199,465 | 4/1980 | Rodriguez | 252/91 |
| 4,380,453 | 4/1983 | Lyle | 8/606 |
| 4,386,010 | 5/1983 | Hildebrandt | 252/428 |
| 4,444,674 | 4/1984 | Gray | 252/91 |
| 4,609,488 | 9/1986 | Geke et al. | 252/344 |

FOREIGN PATENT DOCUMENTS

| | | |
|---|---|---|
| 0116151 | 8/1984 | European Pat. Off. . |
| 1588952 | 9/1968 | France . |
| 2157440 | 6/1973 | France . |
| 2231747 | 12/1974 | France . |
| 2307868 | 11/1976 | France . |
| WO/8301206 | 4/1983 | PCT Int'l Appl. . |

*Primary Examiner*—A. Lionel Clingman
*Assistant Examiner*—Hoa Van Le
*Attorney, Agent, or Firm*—Ernest G. Szoke; Wayne C. Jaeschke; Real J. Grandmaison

[57] ABSTRACT

The method of using polyfunctional quaternary ammonium compounds which are at least substantially insoluble in an aqueous fabric detergent solution and/or are fixed to solids correspondingly insoluble in such aqueous solution, as a soil-collecting, concentration-reducing agent for reducing the demand for conventional detergent components in the aqueous solution.

10 Claims, No Drawings

LAUNDRY DETERGENTS AND CLEANERS WITH REDUCED REQUIREMENT FOR CONVENTIONAL CHEMICALS

BACKGROUND OF THE INVENTION

1. Field of the Invention

This invention pertains to new methods and processes which can be used in the cleaning of articles, especially those soiled with pigment soil, and in particular, the washing or cleaning of all types of articles wherein soil-collecting agents are employed enabling the reduction in demand for conventional detergent components. Textile laundering is one of the most important application areas of the novel methods.

2. Description of Related Art

The subject matter of prior German patent application No. P 35 45 990.5 relates to the use of polyfunctional quaternary ammonium compounds (PQUATs) which are insoluble in aqueous surfactant laundering or cleaning solutions even under the temperature loads of the laundering process and/or are present in immobilized form on solids correspondingly insoluble in these aqueous solutions, as particulate soil-collecting cleaning enhancers in aqueous surfactant laundry and cleaning solutions, and which can be removed manually and/or mechanicallly from the materials to be cleaned after laundering or cleaning. In said earlier application, the laundering power enhancement of conventional aqueous, alkaline textile detergent solutions through the use of such PQUAT soil collectors is particularly described. At least a considerable fraction of the soil solubilized during textile laundering, especially pigmented soil, is taken up by the PQUAT present in a solid phase and thus ultimately transferred from the originally contaminated textile material to be cleaned to the soil collector. In this way, under selective conditions, an increase in the reflectance value of the laundered material can be established.

The teaching of earlier German patent application No. P 36 05 716.9 modifies the use of such PQUATs which are insoluble in aqueous laundering and cleaning solutions and/or are present in immobilized form on solids correspondingly insoluble in these aqueous solutions, in such a way that the new PQUAT-containing auxiliaries are used for at least partial regeneration of soil-loaded cleaning baths, especially for their subsequent reuse. More particularly, according to the teaching of said prior disclosure, especially aqueous, alkaline, if desired surfactant-containing cleaning baths, especially laundering solutions from textile laundering, can be subjected to regeneration in such a way that either during textile laundering and/or subsequent thereto the soiled cleaning bath is treated with the insoluble or immobilized PQUAT and thus at least partly freed from solubilized soil, especially pigmented soil. The laundering solution treated in this way can be reused, for example, within the process of textile laundering. Details on the afore-mentioned teachings may be obtained from these two prior applications Nos. P 35 45 990.5 and P 36 05 716.9, and they also have applicability within the framework of the present invention specification, unless otherwise mentioned herein.

DESCRIPTION OF THE INVENTION

Other than in the operating examples, or where otherwise indicated, all numbers expressing quantities of ingredients or reaction conditions used herein are to be understood as modified in all instances by the term "about".

The present teaching begins with the recognition that the laundering power enhancement upon the simultaneous use of the PQUATs in accordance with this invention can be demonstrated particularly well in the laundering results in textile laundering through an increase in the reflectance value of the laundered material when the laundering is performed at a reduced dosage of individual or several laundry detergent components.

Correspondingly, in a first embodiment, the subject of this invention comprises the use of PQUATs which are insoluble in aqueous laundering and cleaning baths or immobilized on appropriate insoluble solid supports, especially PQUATs of the type mentioned in the earlier applications, in surfactant-containing laundering and/or cleaning agent formulations as soil-absorbing, soil concentration-reducing aids for lowering the demand for conventional chemicals in laundry and cleaning agents. In particular, within the framework of the teaching of the present invention, it is possible not only to substantially reduce the demand for soluble chemical components of currently customary laundering and cleaning agents in conventional laundering and cleaning detergents, but it is also possible to at least partially do without laundering and cleaning agent constituents, known in and of themselves, as will be described in the following. The activity of the PQUATs used in accordance with the invention as soil-absorbing, soil concentration reducing agents can be adjusted in such a distinct way that a number of previously apparently indispensable constituents of standard laundering and detergent formulations can be completely or at least partly omitted therefrom. This surprising state of affairs is made at least partly understandable by the following considerations: The standard present customary detergent formulations fulfill most of the requirements for effective laundering; in this connection, at first only the pigmented soil fraction of the material to be cleaned need be considered. This pigmented soil must be released from the substrate to be cleaned by the detergent under the laundering conditions, and simultaneously solubilized in the wash liquor in such a way that its removal with the used wash liquor including the subsequent rinse stage is ensured, without substantial redeposition of the pigmented soil on the material being cleaned. Understandably, considerable amounts of chemicals are required for this comparatively complex task of a conventional laundering process.

The insoluble auxiliaries of the type mentioned herein and in the earlier applications mentioned, based on PQUATs, absorb the pigmented soil from the cleaning bath and thus make it harmless for possible subsequent undesirable secondary reactions. In the theoretical concept of the laundering bath, the task to be accomplished by the laundering chemical is thus reduced to the release of the soil from the material to be cleaned, and soil transfer and redeposition of soil on the PQUAT recipient. It is thus apparent that the quantities of chemicals required for this process are lower in comparison with conventional laundering and detergent agents, so that the reduction of the content of detergent components all the way to complete elimination of such components previously regarded as indispensable now becomes possible.

The new detergent formulations derived from these considerations as well as their use in laundering and cleaning processes represent further objects of the present invention. In a further embodiment, the invention pertains to PQUAT auxiliaries of the type involved and initially described herein, which are present in especially active form, and thus fulfill the desired goal of reducing the chemical demand in detergent and cleaning solutions especially well. Finally, in a further embodiment, the teaching of the invention provides for the combination of the new technical rules described here in conjunction with the teaching of the previously mentioned prior German patent application No. P 36 05 716.9, from which provision is made for the reuse of the wash bath, purified of pigmented soil. Naturally, this is accompanied by an even more marked reduction of the chemical materials to be discarded, for example with the waste water.

At least for managing the pigmented soil problem in laundering and cleaning processes, especially in textile laundering, it has been found that the following two components are of particular significance: auxiliaries for loosening soil from the material to be cleaned; and soil-accepting, insoluble or insolubly immobilized PQUATs in accordance with the invention. Surfactants are suitable as auxiliaries for soil release and for transferring the released soil to the PQUAT soil collectors. The surfactant composition and its quantity, however, need no longer be adjusted to the requirement that as before, the surfactants must also play an important role in the solubilization of the removed pigmented soil. From this is obtained, in a preferred embodiment of the invention, a reduction in the quantity of the surfactant components needed relative to the surfactant quantities used in conventional laundering and cleaning agents, wherein considerable savings are possible, without incurring substantial losses in the laundering result. Not only does the reduction of the surfactant quantity play a role here; the type of surfactant to be selected is also influenced by the new effect obtained in the new laundering process. For example, excellent laundering results may be obtained using only one class of surfactants, which scarcely has any significance in conventional laundry detergent formulations, but is instead used in the area of cleansing body care agents. This is so with the class of the ether sulfates, especially fatty alcohol ether sulfates, which contain as the polyether segment for example, 1 to 5 ring-opened ethylene oxide residues. Generally, it now becomes possible in accordance with the invention, exclusively or predominantly, to operate with surfactant components selected in a certain way, which are characterized for example by particular ecological safety and/or particularly rapid degradability. As surfactants in this regard, it is possible to mention, for example, the known fatty alcohol sulfates, fatty alcohol ether sulfates, di-salts of α-sulfofatty acids, α-sulfo-fatty acid methyl ester salts, and/or alkylglycosides. However, the principle of the teaching in accordance with this invention is not limited to these specific surfactants. In general, the surfactant classes utilizable in practice coming under consideration can especially be summarized under the concept of anionic surfactants, nonionic surfactants and/or amphoteric surfactants. Keeping in mind the fact that the effect of cleaning not only requires the elimination of pigmented soil, it becomes understandable that precisely the use of surfactant mixtures, for example, of anionic and nonionic surfactants, can be useful. Basically, however, it is true that the quantity of total surfactant needed herein can be distinctly reduced compared to that in conventional detergent formulations. Detailed statements on this area of textile laundering, and especially the wetting of textile materials of a great variety of chemical compositions and origins on the basis of natural and/or synthetic fibers may be found, for example, in Ulmann's Encyclopedia of Industria Chemistry, 4th Edition, Vol. 24, Detergents, especially Subchapter 2, "Theory of the Laundering Process", op. cit., pp. 68 ff, as well as Subchapter 3.1 "Surfactants", and 3.2, "Builders", op. cit., pp. 81–96.

Within the scope of this invention, the possibility has also been found of completely or at least partially avoiding the simultaneous use of conventional phosphate-containing and/or phosphate-free builder components, such as sodium zeolite A, in surfactant-containing formulations which contain insoluble and/or immobilized PQUATs in accordance with the invention. If the surfactant components are selected such that they adequately fulfill their task of dissolving the soil in the presence of builder components, then the insoluble or immobilized PQUATs take on the further task of removing the dissolved particulate soil from the complex laundering process. Retransfer of the soil to the material to be cleaned does not take place, so that high reflectance values can be achieved even in the complete absence of conventional builder components, where as is known according to the prior art, soluble and/or insoluble builder components are intended to precisely combat the undesirable redeposition of particulate soil on the cleaned textile.

The suspension of solubilized soil particles with conventional detergent formulations is usually predicated upon the use of so-called soil carriers such as carboxymethylcellulose or corresponding polymeric soluble components. In accordance with this invention, it is possible to completely or partially eliminate the simultaneous use of these conventional soil-bearing agents. The known expert knowledge in this connection is once again summarized, for example, in the cited reference, Ullmann's Encyclopedia of Industrial Chemistry, 4th Edition, Vol. 24, chapter on "Detergents", especially Subchapter 3.4.2, "Graying Inhibitors".

However, it has also been found that detergent formulation components previously regarded as indispensable are no longer needed, or at least not to the previously customary extent. This especially involves the class of the laundry alkalies. Conventional detergents and cleaners often operate at relatively highly alkaline pH values, wherein the corresponding pH range is ensured by the simultaneous use of the soluble laundering alkalies. Typical laundering alkalies include, for example, water glass, soda ash, and the like. In the laundering process in accordance with this invention, the adjustment of strongly alkaline pH values is possible, but is not necessary. It is possible to operate in the neutral to weakly alkaline pH range, especially when commonly known, suitable surfactant components are selected. For this purpose, buffer systems can be used in a way known in and of themselves, which for example, maintain the pH of the laundering and/or detergent baths in the neutral to slightly alkaline pH range. Numerically this means, for example, that laundering can be performed in the pH range of about 7 to 8.5.

The simultaneous use of otherwise customary detergent formulation components is regulated by the profile of requirements imposed on the detergent. It is possible to mention here, for example, the use of bleaching agents, corresponding activators, enzymes, and the like.

Their simultaneous use within the framework of the new detergents to master the tasks assigned to them may be advantageous; likewise in these embodiments, the goal in accordance with the invention of reducing the total amount of conventional chemicals required is achieved.

As described in detail in the earlier-mentioned applications, the insoluble PQUATs can be used in sheet or film form, or also in the form of a simultaneously usable cloth. In particular, however, in accordance with the invention it is preferred to use these essential auxiliaries in the form of finely-divided solids which permits their dispersed fine distribution in the laundering and cleaning baths, and thus ensures that in the case of the most homogeneous possible distribution of the soil-absorbing PQUATs, each soiled area of the material to be cleaned is washed away by the absorption-ready PQUAT. In this way, the transport pathway of a soil particle released from its original location to the desired deposition location on the PQUAT surface is kept as short as possible. As a result of the movement and mixing of the material to be cleaned, new absorption-ready PQUAT surfaces are constantly made available to the surface of the material to be freed from soil. Accordingly, the reduction of the detergent power still required and the resulting considerations on selection and/or reduction of the surfactant or surfactant quantity and/or the other conventional detergent constituents becomes understandable.

The PQUAT components present as a heterogeneous solid phase in accordance with this invention, on the basis of their cationic character, especially absorb negatively charged soil fractions, for example corresponding particulate soil, from the soil-laden bath. In addition, the PQUAT solid material can act in a cleansing or cleaning-enhancing way on the basis of other surface forces. In the important further embodiments described in the following, it is particularly indicated that not only negatively-charged soil fractions are to be removed in soil-contaminted laundering baths.

For example, within the framework of a usual laundering process, greasy or oily soils present are hydrophilized to such an extent that they dissolve in the wash liquor. In an important embodiment of the invention, together with the particulate soil-collecting PQUAT, likewise in a heterogeneous solid phase, an auxiliary is introduced which is characterized by high absorptivity for oleophilic soils. It is known that selected plastics, for example polyethylene, polypropylene and polyurethane, or superficially strongly hydrophobically finished insoluble solids of any desired origin have the capability to attract an oleophilic soil fraction which has been hydrophilized under the influence of a surfactant from a wash bath and retain it on their surfaces. This operating principle is used for effective cleaning of oleophilic soil-contaminated wash baths in this embodiment. The collectors for such oleophilic soils can be used, for example, in the form of flakes, fibers or fiber structures such as cloths, random fiber webs, poromer sheets and the like. The only essential factor for this component is the requisite, previously stated for the PQUAT cleaners, that a manual and/or mechanical separation between the liquid phase and/or the textile material and the soil collector present in the solid phase should be ensured. In the following, an especially important embodiment thereof will be discussed.

The use of the oleophilic soil-collecting auxiliary can take place simultaneously with the treatment of the wash bath by PQUAT and/or separately from it. The specific working conditions are determined by the nature of the soil in the wash bath and the loading of the soil collecting auxiliaries to be expected as a result.

In a further embodiment of the invention, in addition to the polycationic PQUATs and the oleophilic soil-collecting solids, polyanionic cleaning auxiliaries present in a separate solid phase are also utilized. Polyanionic components in dissolved and/or undissolved form play a considerable role in today's customary laundering and cleaning agents. For example, they are used as builders or cobuilders for the surfactants. They have a versatile number of tasks, one of which may be mentioned is the binding of calcium and/or magnesium ions from the existing water hardness. The following is essential for the embodiment of the invention involved here. Through the planned simultaneous use of insoluble polyanionic components in accordance with the invention, which, like the previously discussed soil-collecting auxiliaries, are used in manually and/or mechanically removable form, it is possible to avoid a negative influence on the simultaneously used polycationic auxiliaries (PQUATs) and the polyanionic auxiliaries discussed here. Both components are provided, spatially separated from one another, in the solid phase, in such a way that each of these auxiliaries can provide its activity without being substantially impaired by the auxiliary having the opposite polarity.

The teaching in accordance with the invention also comprises the joint use of the PQUAT auxiliary and the polyanionic insoluble auxiliary in the presence or in the absence of the previously discussed third soil-collection component, which is especially suitable for taking up the oleophilic soil from the laundering solution.

Suitable insoluble polyanionic solid phases especially include natural and/or synthetic solids with a plurality of anionic acid residues. Insoluble components containing carboxyl groups, sulfonic acid esters, sulfonic acid esters, phosphonic acid groups and the like may be mentioned as typical examples.

Polyfunctional quaternary ammonium compounds (PQUATs) are described and known in the documented state of the art, and are also commercially available in many forms. One important area of application for such compounds is in the area of cosmetic preparations, especially for treating or conditioning the hair. One of the known characteristics of PQUATs is that they are capable of being absorbed on solid surfaces, in particular even in the presence of standard surfactant components. The ability of PQUATs to be absorbed and to remain absorbed on solid surfaces differs according to their composition. The particular composition of the PQUATs plays a crucial role in this regard. However, for the behavior of the PQUATs under the influence of aqueous surfactant baths, the interaction especially with anionic surfactant components may be of determining significance here. In the case of stoichiometric or approximately stoichiometric amounts of the anionic surfactant components, the corresponding anionic surfactant salt usually forms on the quaternary ammonium group. Such PQUAT-anionic surfactant salts generally show a greatly reduced water solubility. Appropriate precipitates form, see for example German Preliminary Published Application No. 22 42 914. Such anionic surfactant salts of PQUATs have been suggested as antistatic agents for application to fibers. However, it is also known in this regard that as a result of considerable excessive amounts of the anionic surfactant, a redissolution of the initially precipitated PQUAT-anionic surfactant salt can occur, see in this regard the publication in Selfen-Öle-Fette-Wachse, pp. 529 to 532 and 612 to 614, 1965. Especially in the reaction diagram on p. 530 of this citation, the formation of solubilized micelle systems of the anionic surfactant-PQUAT complex in the presence of an excess of the anionic surfactant is shown. To be sure, such soluble PQUAT-micelle complexes, especially in the case of dilution with water, still have a certain uptake capacity especially on fibrous materials, but very firmly adhering bonds are not achieved. In particular application, the hair cosmetic field makes use of this; to produce hair conditioners that can be washed out, this field making use of the relationship between soluble and insoluble forms of the PQUAT reaction products with nonionic surfactants and the retained substantivity of such components.

In general, these previously known PQUATs are oligomers and/or polymers which have a majority or plurality of quaternary ammonium groups on their oligomeric or polymeric matrix. In general, adequate water solubility of a PQUAT is required for use in cosmetics. By contrast, the use of PQUATs in accordance with this invention presupposes the insolubility of the PQUAT-based detergency enhancers used as soil collectors in aqueous-surfactant laundry or cleaning solutions. The insolubility of the PQUAT components used as soil collectors in accordance with this invention is actually an absolute prerequisite especially for the area of textile laundering. If this critical condition in accordance with the invention is not met, the desired laundering result is adversely affected. Soluble PQUAT fractions entering the wash bath are attracted to the textile material to be washed, and bind additional pigment soil quantities thereto. The laundering result is then changed to exactly the opposite of that desired. At least a spotty, and sometimes even heavily superficially grayed textile is then obtained as a result of the laundering process.

Nevertheless, in an important embodiment of the invention, it is possible to use all previously known originally water soluble PQUAT components for the application in accordance with this invention. For this purpose it is only necessary to convert the inherently water-soluble and/or water-swellable PQUAT components of the prior art into the desired insoluble form, or to fix them on appropriate water-insoluble carriers and immobilize them in such a way that they cannot be washed off from the carrier during the cleaning process. As will be described hereinafter in detail, various possibilities are available for this purpose.

It is immediately understandable that this condition of insolubility can be fulfilled both by the PQUATs used as cleaning enhancers and by the possibly simultaneously used carrier under the anticipated load of the laundering process and especially the corresponding thermal loading. In this manner, however, it also becomes apparent that polycationic starch ethers, as disclosed in the aforecited European Pat. No. 0 044 003 at best might be used in accordance with this invention under very specific selected conditions which are not therein disclosed. Starches and starch ethers tend to become pasty in the aqueous phase even at moderate temperatures. Chemically, this entails transfer of part of the originally crystalline starch into the dissolved phase. The result of this paste formation, even if it only occurs at certain locations, is the formation of spots on the materials being washed.

The teaching of this invention is based on recognition of this state of affairs. However, general chemical knowledge makes it possible also for the purposes in accordance with the invention to use all polyfunctional quaternary ammonium compounds known from the state of the art, especially those of oligomeric and/or polymeric type, which originally exist in soluble form or show a tendency to dissolve, especially in the presence of an excess of anionic surfactants, with PQUAT-micelle formation.

Suitable polyfunctional quaternary ammonium compounds that may be employed in this invention include those mentioned, for example, in U.S. Pat. Nos. 3,589,978, 3,632,559, 3,910,862, 4,157,388, 4,240,450 and 4,292,212; Great Britain Pat. No. 1,136,842; German Published Application No. 27 27 255 and U.S. Pat. No. 3,472,840 cited therein. More specifically, Great Britain Pat. No. 1,136,842 discloses quaternary ammonium galactomannan derivatives and their use in the formation of paper. The derivatives are quaternary ammonium galactomannan gum ethers wherein at least one hydroxyl group has been reacted with a quaternary ammonium compound such as 2;3 -epoxy- propyl trimethylammonium chloride or 3-chloro-2- hydroxypropyl trimethylammonium chloride.

U.S. Pat. No. 3,472,840 relates to quaternary nitrogen containing cellulose ethers having a backbone of anhydroglucose units with pendant substituent groups bearing a full positive charge spaced along the backbone.

U.S. Pat. No. 4,157,388 is directed to polycationic or polyquaternary ammonium ionenes useful as conditioning agents for hair and textiles.

U.S. Pat. No. 3,632,559 teaches cationically active, water soluble polyamides obtained by alkylation with a bifunctional alkylation agent until the alkylation agent is used up, of a reaction product resulting from the reaction of a dicarboxylic acid or a functional derivative thereof with a polyalkyenepolyamine.

U.S. Pat. No. 4,240,450 relates to compositions for the treatment of keratin material, in particular human hair, comprising a combination of a cationic polymer with an anionic polymer. The anionic polymer contains at least one of a sulfonic acid, carboxylic acid, and phosphoric acid unit, and has a molecular weight of from about 500 to 5 million. The cationic polymer may contain primary, secondary, tertiary or quaterary amino units and have a molecular weight of 500 to 2 million.

U.S. Pat. No. 3,589,978 discloses quaternary ammonium polygalactomamman gum ethers which are prepared by reacting the gums with reactive quaternary ammonium compounds. The starting polygalactomannan gums may be guar gum and locust bean gum.

The starting quaternary ammonium compounds particularly suitable may be defined by the following formula:

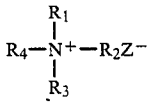

Where $R_1$, $R_2$ and $R_3$ are selected from group consisting of alkyl, substituted alkyl, alkene, aryl and substituted aryl groups, $Z^-$ is an anion and $R_4$ is selected from the group consisting of epoxyalkyl and halohydrin groups. Illustrative of anion $Z^-$ are $Cl^-$, $Br^-$, $I^-$ and $HSO_4^-$.

U.S. Pat. No. 3,910,862 is directed to copolymers of vinyl pyrrolidone containing quaternary ammonium groups. The copolymers are prepared by heating a solution comprising vinyl pyrrolidone and a dilower alkylaminoalkyl acrylate or methacrylate in a solvent therefor in the presence of a free radical initiator at temperatures ranging from about 30° C. to about 100° C. for a sufficient period of time to substantially effect copolymerization, and thereafter admixing the copolymer with a quaternizing agent to quaternize the resulting copolymer.

U.S. Pat. No. 4,292,212 teaches a cationic derivative of a 3 - trimethylamino - 2 hydroxypropyl guar chloride salt. This material contains as the basic unit two mannose units with a glycosidic linkage and a galactose unit attached to one of the hydroxyis of the mannose units. On average, each of the sugar units has three available hydroxyl sites. The hydroxyl groups of the guar are reacted with certain reactive quaternary ammonium compounds to produce the cationic polymers. The quaternary ammonium compounds are commercially available as Cosmediay® c-261 cationic guar.

Suitable originally water-soluble or water-insoluble PQUATs in accordance with this invention preferably have an average molecular weight of at least about 200, preferably at least about 300 and more preferably of at least 1000. The upper limit of the average molecular weight of the PQUATs is basically meaningless and may be, for example, up to 10 million or at even far higher values. This is clear from the water insolubility requirement which the PQUATs have to satisfy in accordance with the invention. If this is assured, no upper limits are set on the molecular weight.

After suitable preparation, for the purposes of the invention, which will be described in more detail hereinafter, suitable PQUATs, initially water soluble but subsequently immobilized on an insoluble carrier, include all polymers which have quaternary ammonium groups either in the polymer chain or attached to the polymer chain. Such quaternary ammonium groups can also be derived from cyclically bonded nitrogen. Examples of such quaternary ammonium groups include corresponding members of 5- or 6-membered ring systems, e.g., morpholine, piperidine, piperazine or indazole rings. Numerous examples of such water-soluble PQUATs are described in greater detail, for example, in U.S. Pat. No. 4,240,450.

Homopolymers or copolymers containing cyclic units of the type described in U.S. Pat. No. 3,912,808 are particularly suitable herein. For example, the homopolymer of dimethyldiallylammonium chloride sold under the tradename Merquat® 100, and the copolymer of dimethyldiallylammonium chloride and acrylamide sold under the tradename Merquat® 550 (Quaternium 41) have this structure.

Other particularly suitable PQUATs include, for example, cellulose ethers wherein the anhydroglucose units each contain from 1 to 3 substituents containing quaternary ammonium groups attached via ether oxygen. Polymers such as these are known, for example, from U.S. Pat. No. 3,472,840. A commercial product having this structure is, for example, Polymer-JR® 400.

Other particularly suitable cationic polymers include, for example, the quaternary polyvinylpyrrolldone copolymers disclosed in U.S. Pat. No. 3,910,862 and commercially available, for example, under the tradename Gafquat® 734 and 755, and the quaternary polymeric urea derivatives disclosed in U.S. Pat. No. 4,157,388, and available, for example, under the tradename Mirapol® A 15. Other suitable copolymers with polycationic characteristics include the polyacrylamide copolymers described in European Patent Application No. 0,153,146, laid open for public inspection, which in particular in addition to 50 mol-% acrylamide units contain up to 50 mol-% of a quaternized aminoalkyl ester of acrylic acid or methacrylic acid. These copolymers are water-soluble. They are applied therein to cloths based on cellulose fibers and become attached thereto on the basis of their natural attractive capacity. Cloths of this type can be washed out and are then to be used, together with anionic surfactant-free surfactant systems, for cleaning hard surfaces, especially for glass cleaning. Under these conditions they are characterized by an increased soil uptake capacity. However, the cleaning cloths mentioned in the document are unsuitable for the use in customary surfactant laundry and detergent baths intended in accordance with this invention, which may also be exposed to temperature loads of up to about 95° C. Considerable portions of the numerous PQUAT copolymers described in the document are released into the wash bath, are attracted to the material to be cleaned, and lead to increased pigment contamination there. Only the conversion of such PQUATs into the physical state that will be mentioned below in accordance with this invention can convert them to cleaning enhancers in accordance with this invention.

Preferred PQUATs in accordance with this invention are those compounds which, in solid form, are difficult to dissolve in water. Cationic polymers such as these are, more preferably, the polygalactomannan derivatives known, for example, from Great Britain Pat. No. 1,136,842. Galactomannans are polysaccharides which occur in the endosperm cells of many leguminosae seeds, but that are only obtained on an industrial scale from locust bean gum, guar gum and tara gum. They are made up of a linear mannan main chain, consisting of mannopyranose building blocks which are attached by B-(1,4)-glycoside bonds and to which individual galactopyranose residues are fixed as branches by -(1,6)-glycoside bonds. The individual polygalactomannans differ from one another primarily in their mannose-galactose ratio. The cationic derivatives of the polygalactomannans are prepared by reacting hydroxyl groups of the polysaccharide with reactive quaternary ammonium compounds. Suitable reactive quaternary ammonium compounds include, for example, those of the following general formula:

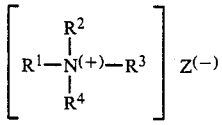

wherein $R^1$, $R^2$ and $R^3$ represent, for example, methyl or ethyl groups, and $R^4$ represents an epoxyalkyl group corresponding to the formula

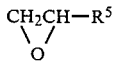

or a halohydrin group of the formula $$X-CH_2-\underset{\underset{OH}{|}}{CH}-R^5-$$

wherein $R^5$ is an alkylene group with 1-3 carbon atoms, X is chlorine or bromine, and Z is an anion, such as, for example chloride, bromide, iodide or hydrogen sulfate. The degree of substitution should be at least about 0.01 and preferably at least about 0.05, and typically falls between about 0.05 and about 0.5. A particularly suitable quaternary ammonium derivative of a polygalactomannan is, for example, guarhydroxypropyltrimethylammonium chloride, which contains cationic groups of the formula $$-CH_2-CH(OH)-CH_2-N(+)-(CH_3)_3]Cl^{(-)}$$

bonded to the oxygen atoms of the hydroxyl groups of the polysaccharide. Such cationic guar derivatives are marketed, for example, under the tradename of "Cosmedia Guar C 261". The degree of substitution (DS) of Cosmedia Guar C 261 is about 0.07. The commercial products "Jaguar C-13" (DS=0.11-0.13) and "Jaguar C 13 S" (DS=0.13) also belong to this type.

In the following will be described the manner in which cleaning-enhancing and particulate soil-collecting auxiliaries in accordance with this invention are produced from all of these or from other comparable, inherently swellable PQUAT starting materials.

Basically, the soil-collecting detergency enhancer used in accordance with this invention may be used in any physical form which enables the detergency enhancer to be charged with soil particles and then manually and/or mechanically removed in undissolved form from the washed fabrics. The PQUATs of the correspondingly PQUAT impregnated insoluble solid materials may be used in particular in two physical forms, namely in the form of sheet-form materials, particularly sheets, films or cloths, and on the other hand in the form of a finely divided solid material which may be dispersed, for example, in the wash liquor during the washing process, but which may be removed with the wash liquor on completion of washing and thus separated from the washed fabrics. The invention is described hereinafter with particular reference to these two embodiments which relate to the joint use of the PQUATs during washing in the wash liquor charged for example with fabrics, although the invention is by no means confined to these two embodiments. The PQUATs may also be used in other forms within the scope of the invention. For example, a wash liquor may be pump-recirculated through a fixed bed of PQUATs and the wash liquor thus treated returned to the washing process.

For washing fabrics, particularly by machine, for example in domestic washing machines, the new detergency enhancers according to the invention may be used in two specific forms, as described in detail hereinafter. On the one hand, the detergency enhancers according to the invention may be incorporated, preferably in the form of fine powders, in typical fabric detergents, more especially heavy-duty detergents; on the other hand, they may be separately added to the wash liquor, i.e. separately from the introduction of the washing powder from dispensers in the machine.

In the latter case, the new soil-collecting detergency enhancers may be made up both as fine and relatively coarse solid particles and, in particular, as a sheet-form material, for example as a sheet, film or cloth. For example, the new detergency enhancers may be manufactured and used as a sheet-form material in roll form, in which case a predetermined quantity of the sheet-form material is taken from the roll for each wash and introduced with the wash into the washing machine.

On completion of the washing process, the soil collector should be manually and/or mechanically removable without difficulty from the wash. When the collector is present as a sheet-form material, its insolubility guarantees ready separation during unloading of the washed fabrics. Where the detergency enhancer is used in the form of a generally finely particulate material, it may be separated in various ways according to the size of the particles. Where the detergency enhancer is introduced into the wash liquor as an extremely finely divided and insoluble material, it may be removed in the usual way with the wash liquor together with other insoluble very finely divided components of the detergent mixture, for example insoluble zeolite-based builder components, and rinsed out. However, if the detergency enhancer is used in the form of fairly coarse particles, it may be manually removed for example by shaking out the washed fabrics.

Sheet-form embodiments of the new soil collector may be made by methods known per se as nonwovens, woven or knitted cloths, as a preferably open-cell foam sheet, as a closed film or in any other form. The only requirement is that the surface over which the wash liquor flows should contain the PQUATs in a sufficient quantity to contact and collect the soil particles.

For all embodiments of the new detergency enhancer according to the invention, the PQUATs used should be substantially insoluble in water or insoluble in the wash liquor to such an extent that the surface of the detergency enhancer in whatever form it is used can become charged with soil particles and retain them until the washing process is over. Insoluble PQUATs of this type may be obtained by various methods. For example, it is known that water-soluble PQUATs can be crosslinked by reaction with at least bifunctional crosslinking agents to such an extent that they become sufficiently insoluble in water for the purposes of the invention. The selection of a suitable crosslinking agent in each case is determined by the structure of the compounds to be crosslinked taking into consideration knowledge of the general chemical subject matter.

A basically different approach, but one which ultimately produces the same result, comprises subsequently applying quaternary ammonium groups to the surface of preferably already formed, insoluble carrier compounds. Thus, for example, in accordance with known methods, the surface of insoluble or insolubilized, formed natural materials and/or corresponding synthesis products can be supplied with quaternary ammonium groups by chemical reaction. Process steps for this purpose are similar to those known in principle from the initially cited literature for the production of water-soluble and/or water-swellable PQUATs. By way of example, this may be illustrated as follows wherein a sheet-form structure such as a nonwoven or a woven or knitted cloth based on natural fibers and/or synthetic fibers may be converted into the desired soil-collecting detergency enhancer by reaction with a coupling component, for example epichlorohydrin, and subsequent reaction with basic nitrogen compound, followed by quaternization, to the desired soil-collecting laundering power enhancer. The same also applies to granular or powder-form material made from natural and/or synthetic water-insoluble starting materials. Other suitable reactive quaternization agents are the quaternary ammonium compounds described in conection with the previously mentioned British Pat. No. 1,136,842, having a reactive epoxy group, or their reaction products with hydrogen halides to form the corresponding halohydrin group.

Especially readily accessible and economical starting materials for such a reactive surface modification, insoluble in laundering and cleaning baths of the type mentioned, are natural substances such as cellulose, insoluble cellulose derivatives, and other insoluble or insolubilized polysaccharide-like natural materials or their derivatives. The introduction of quaternary ammonium group-containing residues proceeds without problems here since the polysaccharide components used as carriers are either initially insoluble, for example, in the case of cellulose, or can be readily converted to the insoluble state by simple chemical reactions, for example with polyfunctional crosslinking agents. A decisive factor in the teaching of this invention is that it is completely sufficient for the suitability of the cleaning enhancers if the quaternary cationic groups are located on the surface of the formed cleaning enhancer, even though the existence of corresponding groups in deeper material layers is not eliminated. Precisely for reasons of accessibility and price, particular importance is attributed to such especially easy and economical to manufacture cleaning enhancers.

This viewpoint can even be influenced by the selection of the forming method. A granulate or powdered solid material selected on the basis of natural materials is usually easier and thus less expensive to obtain than a sheet structure, for example in the sense of woven or knitted cloth. For practical use in the laundering process as well, the employment of such granular or powdered cleaning enhancers with insolubly finished polycationic surfaces can have a special significance. As was previously demonstrated in connection with the teaching of British Pat. No. 1,136,842, even very low average degrees of substitution in the surface of the natural material or natural material derivative lead to effective results in the process in accordance with the invention. Thus it has proven completely adequate, for example, for the use of formed quaternized polysaccharides or polysaccharide derivatives, to work with average degrees of substitution not exceeding 0.5, and especially not exceeding about 0.35. For the cleaning enhancement within the framework of textile launderings, it is particularly advantageous to utilize an average degree of substitution of up to about 0.12 and preferably below 0.1. In general, the average degree of substitution in the range of about 0.01 will be regarded as the lower limit, wherein particularly good results can be obtained in the range of from about 0.015 to 0.08 and especially from about 0.02 to 0.07. It is surprising that fine cellulose powders of such low degrees of substitution cause a substantial enhancement of the laundering power, especially in textile laundering. The concept of laundering power enhancement thus covers the concept of the so-called primary laundering power enhancement as well as the so-called secondary laundering power enhancement. The improvement of the secondary laundering power enhancement, i.e., reduction of the graying tendencies, is still understandable from the concept of the procedures in accordance with the invention. Surprisingly, however, when suitable cleaning enhancers in accordance with this invention are selected, distinct laundering power enhancement of the primary detergency are also obtained, which can be measured as numerically detectable improvements in the degree of brightening within the framework of a textile laundering process on pigment-soiled test materials. Details in this regard will be found in the following examples which illustrate the invention.

Particular practical significance may be attributed to those embodiments in which PQUATS are immobilized, preferably in a thin layer, on the surface of a water-insoluble sheet-form or granular carrier by physical or chemical fixing in such a way that they are unable to escape into the wash liquor to any significant extent, if at all, during the washing process.

It has been found that, by suitably selecting and adapting the structure and composition of the water-insoluble carrier and the PQUAT, it is also possible to exert an influence on the fixation for adequate adhesive strength of the PQUATs on the supporting surface. If, for example, cotton material, and especially unfinished cotton material is used, and this material is coated with water-soluble and/or at least water-swellable PQUATs as defined in the aforementioned literature on cosmetic PQUAT preparations, a soil-collecting detergency enhancer can be obtained which withstands the usual conditions of the laundering process in a textile washing machine, fulfilling its function as a soil collector, and which can be separated from the washed textile material after the laundering process. However, apparently only PQUAT fractions of higher molecular weight are well fixed with additional action of anionic surfactants. In the normal case with this embodiment it is necessary to anticipate disturbances by bleeding-out PQUAT fractions.

It may therefore be desirable to provide a stronger, namely reactive bonding of the PQUAT coating mass to the insoluble carrier. Here, in a known manner, once again a chemical bonding by means of bifunctional coupling components can come into consideration. However, the following method is also of importance for an embodiment in accordance with the invention, i.e., the fixing of a polymeric PQUAT coating on a shaped base article can be provided wherein anionic groups are formed or exist in or on the surface of the base body. Examples of such anionic groups are carboxyl groups, which can be introduced for example by carboxymethylation into the surface of the base body, or other acid groups such as sulfonic acid groups. More detailed statements may be found in the aforementioned U.S. Pat. No. 3,694,364. The cationic PQUAT coating thus attaches itself firmly in the manner of a salt to these counter-ions of the matrix, so that in this manner the solidified bond between insoluble solid and applied PQUAT layer is created. Merely as an example for this embodiment, a carrier based on cellulose fibers may be mentioned, wherein free carboxyl groups have been introduced into the cellulose molecule. This is possible, for example, in two different ways:

- by physical incorporation of compounds containing carboxyl groups in the viscose, i.e. in a cellulose dissolved as cellulose xanthogenate, to form so-called incorporated cellulose fibers; or
- by chemical reaction such as etherification of the fiber-forming cellulose of the reagents containing carboxyl groups to form cellulose fibers modified throughout by, for example, carboxylalkyl groups corresponding to the following formula $$-(CH_2)_n-COOH,$$

wherein n may have a value of from 1 to 3.

The physical incorporation of compounds containing carboxyl groups in the viscose may be obtained, for example, by the addition of alkali metal salts of acrylic acid homopolymers, acrylic acid/methacrylic acid copolymers, alginic acid or carboxymethyl cellulose, to the viscose solution and subsequent spinning into a precipitation bath in the usual way. Products based on cellulose fibers such as these and on fibers modified by carboxymethyl groups are commercially available for numerous applications. In the present embodiment, such fibers or carrier materials prepared therefrom may be coated with a PQUAT layer and hence permanently attached thereto for the application under consideration.

A particularly simple insoluble bonding between an inherently inert carrier and an applied insoluble PQUAT layer can be accomplished by the so-called encapsulation principle. If for example an inert insoluble carrier in fine granular form is enveloped with a PQUAT layer, preferably in such a manner as to cover the surface, and this PQUAT layer is then modified to the required state of insolubility under laundering conditions, in this case as well the inseparable combination between the inert support core and the enveloping PQUAT layer is brought about, even if no particular bonding forces exist between these two materials. The conversion of the PQUAT layer to the insoluble material can take place, for example, once again via the chemical route by cross-linking this surrounding material layer. Understandably, the use of this encapsulation principle is not limited to granular detergency enhancers.

The quaternary ammonium group in the PQUAT components used in accordance with the invention preferably contains from 1 to 3 lower alkyl radicals each containing from 1 to 6 and more especially from 1 to 3 carbon atoms. Particular importance is attributed to the quaternary ammonium group which contains from 1 to 3 alkyl radicals and, as counter-ion, residues of acids of the type normally encountered in the washing process. Examples of such a counter-ion which may be mentioned include chloride and/or sulfate, although these change to the corresponding anionic surfactant salt group in the presence of anionic surfactants, see the mentioned references German Preliminary Published Application No. 2,242,914 and SFÖW (Selfen-Fette-öle-Waschse) 1985, p. 530. As was previously mentioned, such PQUAT-anionic surfactant salt groups can already be formed in the detergency enhancer in accordance with the invention prior to its introduction into the wash bath.

Any suitable insoluble material, inorganic and/or organic in nature, may be employed as an insoluble support material for the fixation of a PQUAT thereto and thus for the immobilization of the soil collecting active components, assuming that they otherwise show inert behavior in the wash solution. Suitable organic support materials may be of vegetable origin. Preferred inorganic support materials include mineral substances of natural and/or synthetic origin, which are present in the form of finely divided solids. PQUAT-coated carrier substances with a specific surface of at least about 0.5 $m^2/g$ are preferably used in accordance with the invention; in particular, the specific surface preferably amounts to at least 1 $m^2/g$. Specific surface is defined here as the surface area which can be coated with PQUAT. Certain mineral materials especially suitable here also have surface areas in the interior of the solid base, whether as a result of their porous structure or their swelling ability, although these are of only limited accessibility, or none at all, for coating with PQUAT. The coatable outer surface, however, can reach considerable values, extending into the range of 100 $m^2/g$ or above, up to for example, 300 $m^2/g$. Colloidal silicas are examples of such surfaces which are extremely coatable with PQUATs.

The maximum particle size of the PQUAT-loaded very fine particles preferably has a value not exceeding about 100μ, preferably not exceeding about 40μ, these numerical values being based on the absolute particle diameters and mean that all or at least the great majority of the existing solid particles correspond to these parameter conditions. It may be especially advantageous for textile laundering to use particles which have an average maximum particle size of up to about 10μ, although the absolute particle size of at least the great majority of all solid particles falls below this value.

Suitable inorganic supports especially include insoluble and fine particulate salts, oxides, silicates and the like. Especially suitable, for example, are aluminosilicates of the type of the zeolites or zeolite-like compounds, especially sodium zeolite A, used on a broad scale in detergents today. Instead, however, zeolite A may also be used in exchanged form, e.g., as the calcium salt.

A particularly suitable mineral carrier material class includes swellable, very finely particulate materials of the type of clays and/or swellable layer silicates, especially from the smectite class. Swellable inorganic minerals of this type are characterized by a particularly large surface area in the swollen state. It is possible to utilize these in the framework of the invention. Particularly suitable herein are the known smectite clays such as montmorilionite, hectorite and/or saponite. Also suitable, however, are comparable synthetic materials of only limited swellability, as are described for example in the earlier filed German patent application No. P 35 26 405.5.

In a preferred embodiment, insoluble PQUATs and/or those immobilized on insoluble supports are used as soil-absorbing, concentration-reducing agents, in which the counter-ion, originally present from the quaternization reaction, has been at least partially replaced by surface-active agents even before introduction into the laundering or cleaning bath. It may be preferred in this process to use corresponding reaction products between an original PQUAT and the surface active agent, in which at least 50 equivalent percent and especially at least about 80 equivalent percent of the quaternary ammonium groups are activated with regard to their counter-ion by exchange with the surface active agent. In a preferred embodiment of the invention, the acticvation of the quaternary ammonium groups is performed by the use of at least equivalent amounts of PQUAT on one hand and surface active agent on the other hand in the preparation step of the soil-absorbing, concentration-reducing agent. Excess amounts of the surface active agent do no harm and may even be preferred. As the surface-active agent, surfactant components used here are especially those which are capable of undergoing such an exchange of the counter-ions originally present. Thus, the counter-ion can be replaced by inherently known anionic surface active agents having detergent properties.

Particularly suitable detergent surface active agents for forming the PQUAT-surfactant complexes include anionic surfactants of the type of laundering-active alcohol sulfates, for example fatty alcohol sulfates of natural and/or synthetic origin, corresponding laundry-active alcohol ether sulfates prepared, for example, from fatty alcohols by alkoxylation, especially by ethoxylation with up to 5 moles of ethylene oxide and subsequent sulfation, also, conventional soaps or other carboxylic acid salts, mixed types such as α-sulfo fatty acid di-salts or the corresponding ether sulfonates. In general, however, the known, laundering-active anionic surfactants may be used herein, such as are enumerated in numerous publications in detergent chemistry. Suitable agents for pretreatment of the PQUATs, however, also include amphoteric surfactants, for example, such as amphoteric surface active agents of the aminocarboxylic acid type. However, the pretreatment of the insoluble PQUATs with surfactants which are not classified as anionic surfactants or amphoteric surfactants also has particular significance in accordance with the invention. Nonionic surfactants especially come under consideration here as activation components.

Details on this known class of materials may be found in the previously mentioned literature reference, Ullmann op. cit. Within this group, in addition to the nonionics customary in today's textile detergents, especially from the class of the condensation products of longer chain alcohols, e.g., fatty alcohols with x mole of ethylene wherein x is preferably equal to or greater than 3, e.g., 3 to 10, laundering-active alkyl glycosides also have a particular significance. Even though the mechanism for such activation has not yet been resolved, it is nevertheless true that an appreciable enhancement of activity can be achieved by pretreatment of the PQUAT soil collectors with nonionics.

The use of the previously mentioned swellable layer silicates of the smectite group and especially the use of swellable, very finely-divided montmorillonite, hectorite or saponite, can be modified as follows. To create the largest possible surface area ready for PQUAT uptake, it is advisable to pre-swell these swellable materials. This pre-swelling can be performed in a pure aqueous phase. In a particular embodiment, however, the internal areas of the swellable materials can be designed such that they assume a supplementary function within the scope of the soil collectors in accordance with the invention. In this embodiment, it is within the scope of the invention to provide the swellable internal structure of these mineral materials with an oleophilic coating, and then to coat layer silicates, finished in this way, on their outer surface with a very thin layer of the PQUAT-surfactant complex. The oleophilically finished internal areas of this solid phase are then in a position to draw up oleophilic soil fractions loosened in the cleaning process and thus to further enhance the cleaning effect of the chemicals. For example, monoquaternary ammonium compounds are suitable for the oleophilic finishing of the inner areas of soil collectors swollen in this way when these compounds bear hydrocarbon residues of limited carbon number, for example with up to 18, and preferably with up to 12 carbon atoms, on the quaternary nitrogen atom. In addition to, or in place of, the subsequent coating of such pretreated layer silicates with the PQUAT-surfactant complexes, appropriately finished layer silicates can also be used as mixing components together with the solids serving as pigmented soil collectors in accordance with the invention.

If soil-absorbing, concentration-reducing agents are used within the scope of the invention, which contain an impregnation with PQUAT or PQUAT-surfactant complex on an organic and/or inorganic, insoluble support, it may be preferred to keep the quantity of this impregnation, based on the total weight of the impregnated solid, in the range of about 0.01 to 20 wt % and especially in the range of about 0.1 to 10 wt %.

The quantity of PQUAT or PQUAT-surfactant complex to be simultaneously used in the laundering agent is adjusted to the expected soil loading. If only a single-time use of this soil absorber is intended, even very small amounts of this absorber are sufficient to bind the pigmented soil, usually obtained, for example, in textile laundering. PQUAT components of the type involved here are capable of binding from an equal amount up to several times their weight of pigmented soil, especially as a result of the distribution of the PQUAT on the supporting substrate and the thickness of the PQUAT layer bound there.

If the teaching of the earlier German Patent Application No. P 36 05 716 is also utilized within the scope of this invention, and if at the same time the used wash bath is to be freed from the insoluble PQUAT soil collectors for reuse of the wash bath, any process method known in and of itself is suitable for phase separation between the wash liquor and the soil collecting solid phase. Manual separation is especially possible in the case of the use of soil collectors in the form of films, cloths and the like. If the PQUAT soil collectors are used in fine particulate solid form, first the material to be cleaned, for example, the textile laundry, can be separated from the wash liquor containing the fine particulate soil absorber. Then, in a second process step, the fine particulate soil absorber can be separated from the wash liquor. This is possible, for example, by filtration by the use of so-called floating filters. In a specific embodiment of the invention, the principle of pigmented soil collection by PQUAT-loaded solid supports can also be used in this second process step. The fine solid particles in the surfactant-containing solutions are ultimately to be regarded as conditioned particulate soil, which can be retained on a separately arranged solid having a PQUAT-surfactant complex loading. Thus, for example, it is possible to conduct the used wash bath containing the very fine particulate soil collectors over sacrificial substrates which in turn are loaded with PQUAT-surfactant complexes. In this step, the primary solid soil-loaded collector particles are retained on the sacrificial substrate, so that the purified wash bath can be withdrawn and conveyed for re-use, while the currently loaded sacrificial substrate, for example, can be discarded.

The crux of the teaching of this invention is the recognition that as a result of the use of the insoluble or insolubilized PQUATs, and especially the PQUAT-surfactant complexes as previously mentioned, as an integral constituent of a textile laundering auxiliary, a reduction in the demand for conventional chemicals in the laundering and cleaning agent is possible. The chemical fraction which affects the elimination of particulate soil is particularly involved herein. The extent of this reduction is determined according to the respectively required performance level and the working conditions used. Conventional typical formulas for textile detergents of a great variety of types and delivery profiles are known to the expert and described in numerous literature references. Reference may also be made to the disclosure in the previously mentioned earlier filed German patent application No. P 35 45 990.5. By means of simple experiments, the respective laundering and cleaning power of systems varied in accordance with this invention can be determined and, considering the desired cleaning results, the extent of reduction of conventional chemical components can be determined.

The invention will now be more clearly understood by reference to the following examples which are set forth as being merely illustrative of the invention and which are not intended, in any manner, to be limitative thereof. Unless otherwise indicated, all parts and percentages are by weight. In the examples, the determination of the laundering power of the detergent formulations is conducted on known artificially soiled test fabrics selected on the basis of different fibers and soils customarily used today in the testing and development of detergent formulations, some of which are commercially available or are produced by the detergent industry according to their own standard. Known manufacturers of corresponding commercial, artificially soiled test fabrics are EMPA, Eidgenossische Materialprufungs- und Versuchsanstalt (Federal Materials Testing and Research Institute), Unterstrasse 11, CH-9001 St. Gallen, (Switzerland); Wascherei-Forschung Krefeld (Krefeld Laundry Research Institute), WFK-Testgewebe - GmbH, Adlerstrasse 44, D-4150 Krefeld (Federal Republic of Germany); Testfabric Inc., 200 Blackford Ave., Middlesex, N.J. USA.

Unless otherwise expressly stated, the laundering experiments for determining the primary detergency ability were performed with soiled standard test fabric swatches, polyester/cotton-based, finished, soiled with pigments and sebum (H-SH-PBV). The degree of soiling of the untreated starting material and the washed fabric samples is determined by measuring the degree of reflectance with an Elrephomat DSC 5 (Carl Zeiss, Oberkochen, Federal Republic of Germany). The degree of soiling of the PBV test fabric determined in this way amounts to 30.0 (% reflectance).

The laundering experiments were performed in the Launderometer. The respective working conditions are stated in connection with the particular examples.

EXAMPLE I

Laundering experiments were performed in the Launderometer under the following conditions. The laundering temperature was 60° C., water hardness (German) was 16° dH, wash liquor ratio of 1:30, 10 steel balls, 30 minutes laundering, 4 rinsing cycles of 30 seconds each.

Test swatches based on polyester/cotton fabric, soiled with standard soil (standard soil H-SH-PBV) were used as the material to be laundered.

Two series of laundering experiments were performed.

EXPERIMENTAL SERIES 1

In all instances, only a surfactant based on fatty alcohol ether sulfate (Texapon N 25) was added to the wash bath, in each instance in a quantity of 0.5 g active substance/l wash bath. Together with it, in two different concentrations, namely 0.5 g/l and 2.5 g/l, various PQUAT-coated solids based on a highly swellable montmorillonite ("Dis-Thix-Extra") were used in the wash bath. For comparison, un-coated layer silicate "Dis-Thix-Extra" was added to the wash bath.

In a second group of this Experimental Series 1, the same PQUAT coatings were used, but applied to detergent grade sodium zeolite A ("Sasil"). In this instance also, un-coated "Sasil" was used in the comparison experiment.

EXPERIMENTAL SERIES 2

The tests from Experimental Series 1 were repeated. Here, however, instead of the surfactant addition from Experimental Series 1, 5 g of a high quality powdered standard textile detergent per liter of wash bath was used.

The solid components used in these detergent experiments are as follows:

1. Test products with PQUAT (Cosmedia Guar C 261) (Texapon N 25 (FAES))-loaded carrier substances in parts by weight (number ratios in parts by weight active substances):

(a) layer silicate "Dis-Thix-Extra" (DTE)
- Test No. 580–DTE+Formula II*
- Test No. 582–568 (DTE:Guar 10:1)+Texapon N 25 (1:5)
- Test No. 583–569 (DTE:Guar 20:1)+Texapon N 25 (1:5)
- Test No. 584–569 (DTE:Guar 20:1)+Texapon N 25 (1:5)+0.2% preservative (Bronidox)

(b) Na-Zeolite A "Sasil"
- Test No. 581–Sasil+Formula II*
- Test No. 582–572 (Sasil:Guar 10:1)+Texapon N 25 (1:5)
- Test No. 586–573 (Sasil:Guar 20:1)+Texapon N 25 (1:5)
- Test No. 587–573 (Sasil:Guar 20:1)+Texapon N 25 (1:5)+0.2% preservative (Bronidox)

For comparison: untreated "Dis-Thix-Extra" untreated "Sasil"

*Formula II:
- 0.5Cosmedia Guar C 261 (Guar)
- 53.6% Texapon N 25
- 0.2% preservative (Bronidox)
- 45.7% water The laundering results obtained in the Launderometer are summarized in table 1 and table 2 below. The numerial values given in each case are the measured reflectance values (% reflectance, Elrephofilter 6).

TABLE 1

| | | 3rd Laundering Result | | | | |
|---|---|---|---|---|---|---|
| | Without additive | Dis-Thix-Extra | 580 | 582 | 583 | 584 |
| 0.5 g surfactant-AS/l + | 44.8 | 48.9 | 70.7 | 71.0 | 73.7 | 77.5 |
| 0.5 g test product/l | — | light gray residue | gray residue | gray residue | gray residue | gray residue |
| 0.5 g surfactant-AS/l + | 44.8 | 53.5 | 78.3 | 79.3 | 78.9 | 80.0 |
| 2.5 g test product/l | — | gray residue | dark gray residue | heavy dark gray residue | dark gray residue | dark gray residue |

TABLE 1-continued

| | Without additive | 3rd Laundering Result Dis-Thix-Extra | 580 | 582 | 583 | 584 |
|---|---|---|---|---|---|---|
| 5 g standard detergent/l + 0.5 g test product/l | 77.9 gray residue | 74.0 dark gray residue | 78.9 gray residue | 78.6 gray residue | 81.9 gray residue | 81.3 dark gray residue |
| 5 g standard detergent/l + 2.5 g test product/l | 77.9 gray residue | 73.5 heavy dark gray residue | 82.3 gray residue | 81.9 heavy gray residue | 82.2 gray residue | 82.2 heavy gray residue |

TABLE 2

| | Sasil | 581 | 585 | 586 | 587 |
|---|---|---|---|---|---|
| 0.5 g surfactant-AS/l + 0.5 g test product/l | 43.4 slight light gray residue | 70.0 gray residue | 62.1 gray residue | 65.5 gray residue | 68.9 gray residue |
| 0.5 g surfactant-AS/l + 2.5 g test product/l | 51.3 slight light gray residue | 69.6 gray residue | 66.0 gray residue | 71.1 gray residue | 71.6 gray residue |
| 5 g standard detergent/l + 0.5 g test product/l | 78.2 gray residue | 81.0 gray residue | 79.8 gray residue | 80.6 gray residue | 80.3 gray residue |
| 5 g standard detergent/l + 2.5 g test product/l | 78.6 gray residue | 81.8 gray residue | 80.3 dark gray residue | 81.0 dark gray residue | 80.4 gray residue |

EXAMPLE II

Cellulose powder having an average particle size of less than 50μ was quaternized, with 3-chloro-2-hydroxypropyltrimethylammonium chloride to a mean degree of substitution (MS) of 0.05. The quaternized product was treated by trickling it over an aqueous solution of a fatty alcohol ether sulfate (Texaphon NSO), and the combination was intimately mixed. The weight ratio selected amounted to 10 parts of the quaternized cellulose per part (active substance) of the surfactant component. The mixing time in each instance was at least 15 minutes.

In Launderometer experiments, first the laundering ability of an aqueous wash bath was determined containing 3 g/l of a conventional powdered standard detergent. In this process the wash bath was reused in 4 successive washings. In a parallel experiment, the quaternized cellulose powder pretreated with the fatty alcohol ether sulfate (FAES) surfactant was added in a quantity of 5 g/l to a bath containing another 3 g/l of the powdered standard detergent. This bath was also used in 4 successive launderings. Specifically, the following working conditions were used.

Launderometer, laundering temperature of 60° C., 16° dH water hardness, 3 steel balls, H-SH-PBV fabric, 15 minutes washing, 4 rinsing cycles of 30 seconds each.

In Table 3 which follows, the reflectance values of the laundering results obtained in the absence of the PQUATs (Experimental Series A) were compared with the laundering results, in each instance determined as the % reflectance, of the same bath, to which the quaternized cellulose powder pretreated with surfactant had been added (Experimental Series B).

TABLE 3

| % reflectance | A | B |
|---|---|---|
| after 1 washing | 40.4 | 47.3 |
| after 2 washings | 31.9 | 46.1 |
| after 3 washings | 30.8 | 45.8 |
| after 4 washings | 30.4 | 44.0 |

In a comparison experiment, the surfactant-pretreated quaternized cellulose powder was washed intensively several times with distilled water at room temperature before use in order to remove any excess surfactant from the cellulose powder. Using the material pretreated in this way, once again 4 successive Launderometer launderings were performed under the previously indicated conditions. The laundering results, determined as the % reflectance, were as follows:

after 1 washing 48.6
after 2 washings 45.8
after 3 washings 40.6
after 4 washings 37.0

It is also apparent here that the laundering result was distinctly improved in comparison to the laundering in the absence of the PQUAT. The results of the third washing here correspond approximately to the first washing result with the PQUAT-free detergent bath (Series A).

EXAMPLE III

Powdered cellulose was quaternized with 3-chloro-2-hydroxypropyl-trimethylammonium chloride to a mean degree of substitution of about 0.3. The effect of the addition of increasing quantities of this insoluble PQUAT on the laundering action of a pure nonionic surfactant bath with simultaneously increasing quantities of the nonionic surfactant was investigated. The nonionic surfactant used was a fatty alcohol ethoxylate with an average of 7 ethoxy groups in the polyethoxy residue (Dehydol LT 7).

The conditions of the laundering experiment were as follows:

Launderometer, laundering temperature of 30° C., 16° dH water hardness, bath ratio 1:30, 10 steel balls, H-SH-PBV fabric, 30 minutes washing, 4 rinsing cycles of 30 seconds each.

Addition rates: 0.1, 0.2, 0.3, 0.4, 0.5 and 1.0 g nonionic surfactant/l

Plus 0,1.0, 1.5, 2.0 and 3.0 g PQUAT/l.

The laundering results obtained as % reflectance (% R) are summarized in Table 4, shown below.

TABLE 4

| % R Dehydol LT 7 | 0.1 | 0.2 | 0.3 | 0.4 | 0.5 | 1.0 |
|---|---|---|---|---|---|---|
| + 0 g PQUAT/l | 38.9 | 44.4 | 52.5 | 59.5 | 61.1 | 63.4 |

TABLE 4-continued

| % R Dehydol LT 7 | 0.1 | 0.2 | 0.3 | 0.4 | 0.5 | 1.0 |
|---|---|---|---|---|---|---|
| + 1.0 g PQUAT/l | 50.7 | 53.9 | 60.3 | 62.0 | 59.0 | 59.8 |
| + 1.5 g PQUAT/l | 52.7 | 56.0 | 60.5 | 62.9 | 64.4 | 67.1 |
| + 2.0 g PQUAT/l | 52.9 | 56.7 | 61.5 | 64.7 | 65.2 | 69.6 |
| + 3.0 g PQUAT/l | 52.8 | 56.3 | 63.0 | 68.7 | 69.0 | 72.8 |

EXAMPLE IV

The laundering experiments of Example III were repeated. However, a fatty alcohol mixed ether (EO-PO adduct "Dehypon LS 54") was used as the nonionic surfactant.

The laundering results obtained under otherwise identical working conditions, once again determined by % reflectance, are summarized in Table 5 below.

However, in a parallel experiment under comparable conditions, a quaternized cellulose having an average degree of substitution of about 0.1 was used. The % reflectance results obtained in these laundering experiments are summarized in Table 6 below.

TABLE 5

| % R Dehypon LS 54 | 0.1 | 0.2 | 0.3 | 0.4 | 0.5 | 1.0 |
|---|---|---|---|---|---|---|
| + 0 g PQUAT/l | 38.0 | 50.5 | 54.6 | 57.0 | 57.6 | 60.8 |
| + 1.0 g PQUAT/l | 49.0 | 53.4 | 52.5 | 60.7 | 61.4 | 63.9 |
| + 1.5 g PQUAT/l | 49.7 | 56.5 | 57.0 | 62.8 | 67.2 | 69.5 |
| + 2.0 g PQUAT/l | 51.1 | 58.5 | 63.4 | 63.4 | 67.6 | 70.1 |
| + 3.0 g PQUAT/l | 51.4 | 59.7 | 64.5 | 65.3 | 68.2 | 73.4 |

TABLE 6

| % R Dehypon LS 54 | 0.1 | 0.2 | 0.3 | 0.4 | 0.5 | 1.0 |
|---|---|---|---|---|---|---|
| + 0 g PQUAT/l | 37.9 | 49.6 | 54.6 | 56.3 | 57.5 | 61.3 |
| + 1.0 g PQUAT/l | 46.0 | 52.0 | 55.1 | 55.3 | 55.7 | 55.9 |
| + 1.5 g PQUAT/l | 47.3 | 54.3 | 57.1 | 58.4 | 60.0 | 64.0 |
| + 2.0 g PQUAT/l | 48.8 | 56.7 | 59.6 | 60.0 | 64.9 | 67.4 |
| + 3.0 g PQUAT/l | 49.5 | 57.7 | 62.5 | 63.7 | 66.0 | 69.5 |

EXAMPLE V

Laundering experiments were performed, reusing a pure nonionic surfactant wash bath. Specifically, the following conditions were used:

Launderometer, laundering temperature of 30° C., 16° dH water hardness, bath ratio 1:30, 10 steel balls, H-SH-PBV fabric, 30 minutes washing, 4 rinsing cycles of 30 seconds each.

Six washings were performed with the same wash bath, but in each case fresh test fabrics (2 H-SH-PBV/2 filler fabrics) were used.

In a first experimental series an aqueous 0.3 g/l fatty alcohol ethoxylate (Dehydol LT 7)-containing bath was used. In a comparison experiment, at the same concentration of the nonionic surfactant component in the aqueous bath, quaternized cellulose having a mean degree of substitution of about 0.3 was added to the bath in a quantity of about 2g/l. In this process, however, the following procedure was utilized in producing the bath: The quaternized cellulose was first soaked with the nonionic surfactant component as a 10% aqueous solution; the mixture was allowed to stand, shaking occasionally, for about 10 minutes. Then it was diluted to the selected bath concentration with water.

The results obtained in the laundering experiments are summarized in Table 7 below. Experimental Series A reproduces the laundering results with the pure nonionic surfactant bath, while Experimental Series B represents the laundering results of the PQUAT-nonionic surfactant-containing bath.

TABLE 7

| % reflectance | A | B |
|---|---|---|
| 1st laundering | 56.0 | 60.5 |
| 2nd laundering | 40.7 | 52.8 |
| 3rd laundering | 34.2 | 46.8 |
| 4th laundering | 32.3 | 43.5 |
| 5th laundering | 31.0 | 39.2 |
| 6th laundering | 30.3 | 35.6 |

We claim:

1. A process for laundering or cleaning soiled textile material comprising treating said textile material in an aqueous detergent wash bath whereby pigmented or fatty soils are loosened from said soiled textile material, and contacting said wash bath with a polyfunctional quaternary ammonium compound which is insoluble or is fixed to a solid which is insoluble in said wash bath, said polyfunctional quaternary ammonium compound having a counter-ion which has been at least partly replaced by a surface-active agent, to collect from said wash bath at least a portion of said soils loosened from said textile and thereby reduce the demand for conventional detergent components in said wash bath, said polyfunctional quaternary ammonium compound being in the form of a finely-divided, particulate solid having a maximum average particle size of about 100 microns.

2. A process in accordance with claim 1 including manually or mechanically separating said polyfunctional quaternary ammonium compound from said wash bath.

3. A process in accordance with claim 1 wherein said wash bath is free of conventional phosphate-containing or phosphate-free builder components.

4. A process in accordance with claim 1 wherein said wash bath is free of conventional soil-carrying agents.

5. A process in accordance with claim 1 wherein said wash bath is at least partially free of conventional detergent alkalies.

6. A process in accordance with claim 1 wherein said wash bath contains ecologically safe or readily degradable surfactants selected from fatty alcohol sulfates, fatty alcohol ether sulfates, α-sulfo-fatty acid di-salts, α-sulfo-fatty acid ester salts, and alkylglycosides.

7. A process in accordance with claim 1 wherein said polyfunctional quaternary ammonium compound is dispersed throughout said wash bath.

8. A process in accordance with claim 1 wherein said solid has a specific outer surface area of at least about 0.5 $m^2/g$.

9. A process in accordance with claim 1 wherein said polyfunctional quaternary ammonium compound has been activated by pretreatment with an anionic, amphoteric or nonionic surface active agent.

10. A process in accordance with claim 1 wherein said polyfunctional quaternary ammonium compound has been treated with a bifunctional cross-linking agent to render it insoluble in water.

* * * * *